United States Patent [19]

Lott

[11] 4,189,720

[45] Feb. 19, 1980

[54] REPEATER FOR SMOKE AND SIMILAR ALARMS

[76] Inventor: Thomas M. Lott, 55 W. Santa Inez, San Mateo, Calif. 94022

[21] Appl. No.: 840,320

[22] Filed: Oct. 7, 1977

[51] Int. Cl.[2] ..... G08B 17/10

[52] U.S. Cl. ..... 340/539; 340/531; 340/628

[58] Field of Search ..... 340/213 R, 224, 274 R, 340/276, 305, 306, 412, 416, 421, 500, 517, 531, 532, 539, 540, 545, 628, 629, 630

[56] References Cited

U.S. PATENT DOCUMENTS

| | | | |
|---|---|---|---|
| 3,192,516 | 6/1965 | Simpkins et al. | 340/224 |
| 3,257,653 | 6/1966 | McCorkindale | 340/224 |

*Primary Examiner*—Alvin H. Waring

[57] ABSTRACT

A repeater is provided for a smoke alarm or similar alarm device which picks up the sound from the alarm device and transmits a coded radio signal to a receiver at a remote location. This receiver includes an integrator set for some convenient time interval to prevent false triggering. In accordance with a preferred embodiment of the invention, the receiver may incorporate a location indicator and be used with a plurality of transmitters.

4 Claims, 2 Drawing Figures

REPEATER FOR SMOKE AND SIMILAR ALARMS

SUMMARY OF THE INVENTION

Alarm devices have long been known and smoke detecting devices have become very popular in recent years. One difficulty with such devices is that one must be in the immediate vicinity of the device to hear the alarm except in the case of very expensive remote installations.

Although the smoke detector itself could incorporate a radio or other transmitter for sounding an alarm at a remote point, this greatly complicates the device and it would require the approval of various agencies to modify the devices.

Smoke detectors are made in mass production and are available at very low prices. On the other hand, the devices for transmitting a signal to a remote location have been relatively expensive.

Accordingly, it is an object of the present invention to provide a repeater for a smoke alarm or similar alarm which is not physically connected to the alarm so that low cost, mass produced alarm devices can be incorporated in a remote sensing system.

In accordance with one embodiment of the invention, the transmitter includes a pulse encoder and the receiver incorporates a pulse decoder whereby one can use a plurality of transmitters operating into a single receiver and the receiver will indicate the location of the transmitted signal.

A further object of the present invention is to provide such an alarm repeater device wherein the receiver is compact and can be easily moved from place to place. For instance, when leaving home, one could leave the receiver with a neighbor so that the alarm would be transmitted into the neighbor's home.

Various other objects and features of the invention will be brought out in the balance of the specification.

DESCRIPTION OF THE PREFERRED EMBODIMENTS

In smoke detectors, a high level signal of about 85 db is produced at a frequency of 2500–3500 Hz. The transmitter of the present invention should be placed within 10 feet of such a smoke detector and include a filter circuit with a band pass compatible with the frequency of the smoke detector signal.

Figure 1:
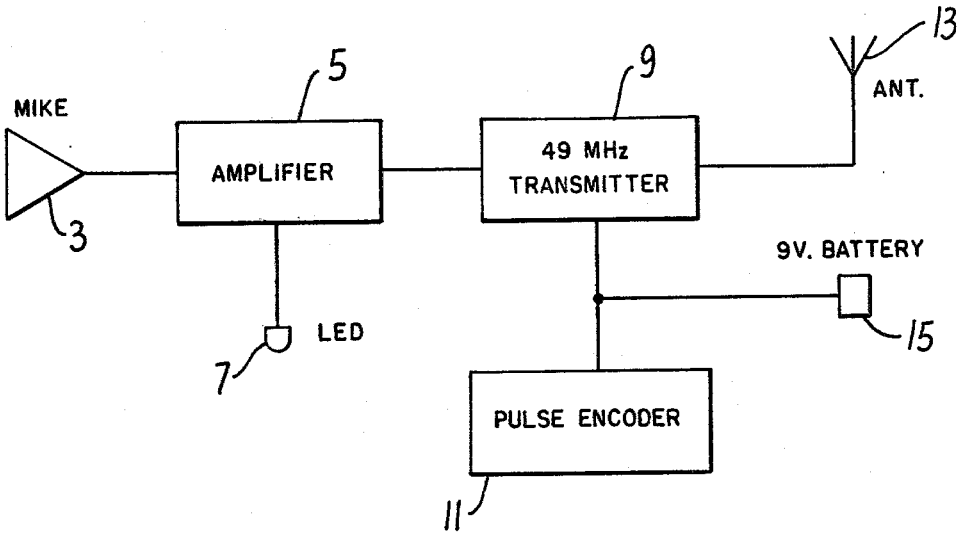
FIG. 1 is a schematic diagram of a transmitter embodying the present invention.

Referring now to FIG. 1, the transmitter includes a microphone 3 with its output leading to an amplifier 5. The amplifier is preferably a low drain IC such as that sold under the designation of Supertex SD1. The amplifier has a pass band of about 2500–3500 Hz in order to help eliminate false triggering. The amplifier includes a LED 7 which flashes every 40 seconds to indicate that the device is working. The transmitter 9 receives the output of the amplifier as well as that of a pulse encoder 11 and feeds the antennae 13 with an encoded signal. A battery 15 supplies power to the system. In the drawing, the transmitter is shown as operating at 49 MHz as this is an allowable frequency for such purposes; obviously the transmitter could operate on any frequency acceptable to government authorities.

Figure 2:
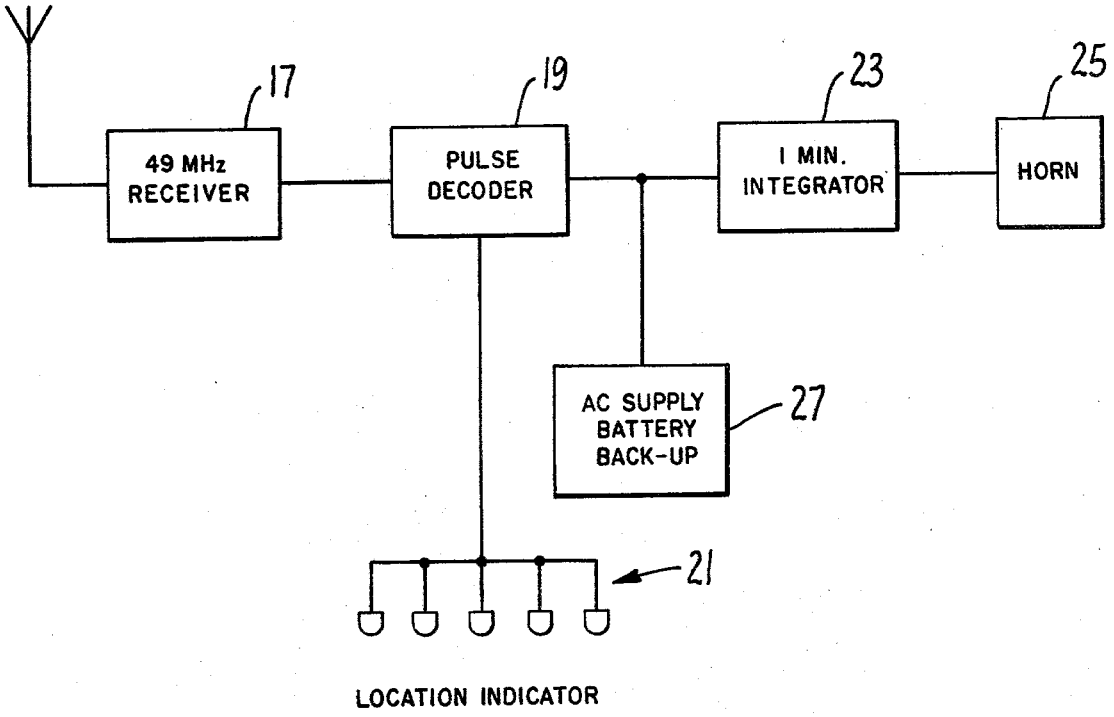
FIG. 2 is a schematic diagram of a receiver embodying the present invention.

Referring now to the receiver shown in FIG. 2, the receiver 17 receives a signal from the transmitter described above and transmits the signal to a pulse decoder 19. The pulse decoder determines which code has been sent and lights up an appropriate one of the several LEDs 21. This permits a number of transmitters having different coded signals to operate into a single receiver and to permit the user to easily distinguish which of the transmitters is sending out a signal. This saves valuable time in tracking down the source of the fire or other alarm. The pulse decoder also sends a signal to the integrator 23. This integrator is set for a relatively long time interval, such as one minute, to prevent false triggering. In other words, various other noise sources in a room might fall within the pass band of the transmitter and would therefore cause a false alarm. However, such extraneous noises would not be steady for a relatively long period such as one minute so that by providing an integrator, one prevents false triggering. If a signal does continue for a sufficient length of time, horn 25 or other visual or audible warning device is activated to warn the user that the transmitter has picked up a warning signal of the proper frequency and duration.

In the device described wherein the signal is first encoded and then decoded, a number of transmitters can be employed with a single receiver. If only a single transmitter is to be employed in remote locations where there would be no interference from other systems, the encoding and decoding can be eliminated.

Although a specific embodiment of the invention has been set forth, it would be obvious to those skilled in the art that various modifications can be made of the specific circuitry shown without departing from the spirit of this invention.

The receiver is operated from a suitable power supply 27 which preferably consists of an AC supply with a battery backup in case the normal main current fails.

I claim:

1. A remote alarm indicator system for a smoke detector alarm and similar alarms which produce, upon actuation, an audible alarm signal for a substantial period of time, said remote alarm indicator system comprising:

(a) transmitter means located near each said smoke detector alarm and including microphone means responsive to said audible alarm signal produced by said smoke detector alarm, amplifier means operatively connected to the output of said microphone means, said amplifier means including band pass filter means having a band pass characteristic compatible with the frequency range of the said audible alarm signal produced by said smoke detector alarm, and R. F. signal transmitting means operatively connected to the output of said amplifier means;

(b) radio receiver means, remotely located from said transmitter means, for receiving the signal transmitted by said R. F. signal transmitting means, said radio receiver means including integrator means for integrating the signal received from said R. F. signal transmitting means over a predetermined time interval and further including alarm warning means, connected to the output of said integrator means, which is activated by the said integrator means to render an alarm indication when the said signal received from said R. F. signal transmitting means persists for the predetermined time interval of said integrator means;

(c) said transmitter means further including signal encoding means and said radio receiver means further including signal decoding means; and wherein, (d) said radio receiver means further includes means to indicate the location of each transmitter means.

2. The remote alarm indicator system of claim 1 wherein said predetermined time interval is substantially one minute.

3. The remote alarm indicator system of claim 2 wherein the frequency of the signal generated by said R. F. signal transmitting means and received by said radio receiver means is 49 MHz.

4. The remote alarm indicator system of claim 3 wherein the audible frequency range of said audible alarm signal produced by said smoke detector alarm is 2500–3500 MHz.

* * * * *